US006354699B1

(12) United States Patent
Michele et al.

(10) Patent No.: US 6,354,699 B1
(45) Date of Patent: Mar. 12, 2002

(54) PROCEDURE FOR MANUFACTURING AN INK CARTRIDGE FOR AN INKJET PRINTER

(75) Inventors: Helmut Michele, Castrop-Rauxel; Dirk Klein, Hagen; Peter Busch, Bochum, all of (DE)

(73) Assignee: Artech GmbH design + production in plastic (DE)

( * ) Notice: Subject to any disclaimer, the term of this patent is extended or adjusted under 35 U.S.C. 154(b) by 0 days.

(21) Appl. No.: 09/661,120

(22) Filed: Sep. 13, 2000

(51) Int. Cl.[7] ..... B41J 2/175
(52) U.S. Cl. ..... 347/85
(58) Field of Search ..... 347/84, 85, 86, 347/87, 92, 93

(56) References Cited

U.S. PATENT DOCUMENTS 6,238,042 B1 * 5/2001 Kobayashi et al. ..... 347/86

FOREIGN PATENT DOCUMENTS

EP 0 703 083 3/1996 ..... B41J/2/175
EP 0 864 428 9/1998 ..... B41J/2/175

* cited by examiner

*Primary Examiner*—N. Le
*Assistant Examiner*—Anh T. N. Vo
(74) *Attorney, Agent, or Firm*—Hoffman, Wasson & Gitler

(57) ABSTRACT

The present invention pertains to a procedure for manufacturing an ink-filled ink cartridge for an inkjet printer, which, for the withdrawal of ink, has connected to the ink space a tubular dome, the outer end of which is closed off by a pierceable, airtight, elastic membrane, and the inner end of which is covered with a fine-mesh filter screen, with the procedural steps: (1) evacuation of the ink space to a filling vacuum, (2) filling of ink into the ink space, (3) ventilating of the ink space, (4) evacuation of the ink space to transport vacuum, sealing of the ink space. In order to reduce as much as possible the air amount trapped in the dome during filling, the invention suggests that before the evacuation to transport vacuum, a stiff covering be applied from the outside in front of the membrane in a sealing manner, thus trapping a defined air volume.

8 Claims, 2 Drawing Sheets

PROCEDURE FOR MANUFACTURING AN INK CARTRIDGE FOR AN INKJET PRINTER

BACKGROUND OF THE INVENTION

Figure 1:
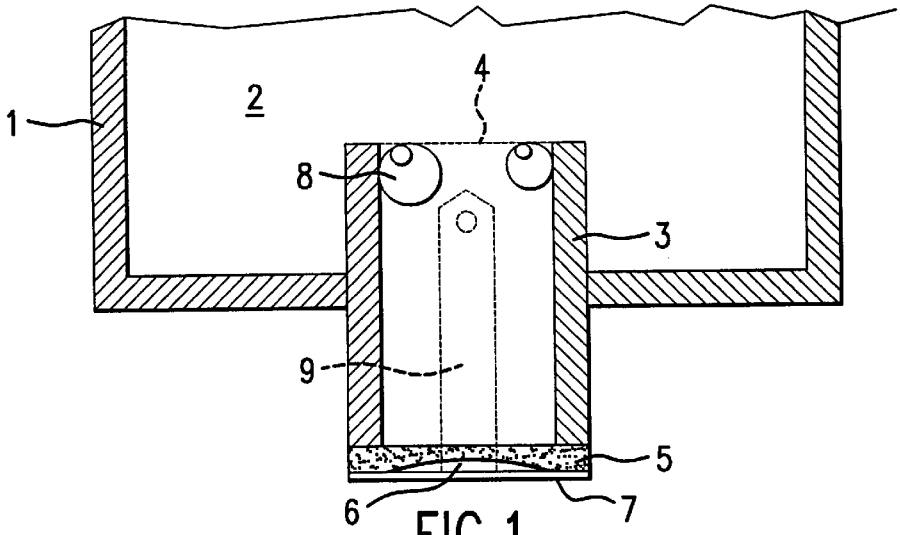

The invention pertains to a procedure for manufacturing an ink-filled ink cartridge for an inkjet printer, which, for the withdrawal of ink, has connected to the ink space a tubular dome, the outer end of which is closed off by a pierceable, airtight, elastic membrane, and the inner end of which is covered with a fine-mesh filter screen, with the procedural steps: (1) evacuation of the ink space to a filling vacuum, (2) filling of ink into the ink space, (3) ventilating of the ink space, (4) evacuation of the ink space to transport vacuum, (5) sealing. of the ink space.

Ink cartridges that are used as disposable ink reservoirs for inkjet printers and plotters have an ink space this is filled with ink in as gas-free a manner as possible during manufacture. The supplying of ink to a printer that is connected to it takes place through a hollow needle, which, when the ink cartridge is inserted axially, is pushed into a dome which is in the form of a tube section especially designed for that purpose, and which is connected with the actual ink space so that ink can be drawn through the hollow needle by the printer.

Ink cartridges with an ink space that is filled with an open-pore foam that stores the ink exist, as do those with ink that flows freely within the ink space. In both designs, the dome is closed off on the inside by means of a fine screen that serves as a filter and is supposed to prevent larger particles from getting through the hollow needle into the pressure system and causing malfunctions there. The outer end of the dome is designed for the sealed seating of the hollow needle of the printer. Provided for this purpose is either a seal with a preformed opening for seating the hollow needle, or an airtight membrane that can be pierced by the hollow needle in the manner of a septum. This version has the particular advantage that no air from outside can get into the ink space through the arbor before the start of operation.

It is of decisive importance for the functional reliability of an ink cartridge that no air gets into the ink space and is trapped there while the ink is being filled. Air bubbles, particularly those above a certain size, lead to malfunctions in the pressure system especially when they are trapped in the dome, i.e., under the filter screen, so that they can be drawn in by the hollow needle.

In order to keep the trapped quantity of air to a minimum, vacuum filling procedures have already been described in EP 0 703 083 A2 and EP 0 864 428 A2, in which the ink space is first provided with a relatively high filling vacuum (more than 95%), ink is then injected, and the ink space is again brought to transport vacuum of about 50% before the final, gastight sealing of the ink space. This transport vacuum ensures that no ink is forced out when the ink cartridge is put into operation under lower atmospheric pressure or higher temperatures than during the filling.

In the last-cited EP 0 864 428 A2, in order to avoid air bubbles in the dome, it is suggested that the discharge opening be sealed by means of an air-permeable film so that air trapped in the dome can escape during the subsequent packaging of the ink cartridge in a vacuum bag. However, the use of this air-permeable sealing film does bring with it the disadvantage, which has to be taken into consideration, that air can again enter the dome from outside as soon as the ink cartridge is removed from the protective vacuum packaging. This is unsatisfactory, in that an inadvertently unpacked ink cartridge becomes unusable after only a short time. Under some circumstances this can mean that malfunctions can occur simply because of too long a wait before inserting the ink cartridge into the printer.

BRIEF SUMMARY OF THE PRESENT INVENTION

The task of the invention consists in solving the abovementioned problem, namely, to provide a procedure which makes possible a permanent minimization of the amount of air in the dome, and specifically, even if the ink cartridge is no longer in a protective vacuum package.

To solve the abovementioned problem, the procedure according to the invention suggests that before the evacuation to transport vacuum, a stiff covering be applied from the outside in front of the membrane in a sealing manner, thus trapping a defined volume of air.

The characteristic feature of the procedure according to the invention is that by means of the elastic membrane of the septum with the rigid, inelastic covering, and the volume of gas trapped in between, a gas spring buffer is formed that acts upon the interior of the dome. This makes possible a nearly complete removal of air bubbles from the dome, and specifically, independent of the ambient atmospheric conditions, as is explained in the following.

The trapping of a certain residual amount of air cannot be avoided during the injection of the ink into the ink space that has been provided with the filling vacuum. Specifically, at a prevailing negative pressure of about 95–97%, 5–3% residual air accordingly remains behind, which remains in the form of air bubbles in the volume of ink that has been filled, and preferably under the filter screen in the dome where they are particularly harmful. Thanks to the design according to the invention, as soon as the ink space is provided with the transport vacuum of about 50% of atmospheric pressure, as a result of the negative pressure prevailing in the ink space the membrane will be pressed inward into the interior of the dome while deforming elastically. As a result of the negative pressure during this evacuation, air bubbles that may be trapped in the dome will be pressed through the filter screen and into the ink space, specifically due to the expansion of the trapped volume of air. Before the airtight sealing, they can then either be completely drawn off through the ventilation opening, or they can remain above the filter screen in the ink space where they do no harm to the perfect operation of the ink cartridge.

Of particular practical importance with regard to the invention is the fact that the compliance of the membrane, and thus the degree of inward pressing into the dome during the evacuation of the ink space can be adjusted by means of the volume of air trapped between the membrane and the covering according to the invention. The less the trapped volume of air, the less elastic inward pressing of the membrane there will be, regardless of the ambient atmospheric conditions. As a result, it can be specifically avoided that the force acting on the membrane from outside during the evacuation becomes too great and the membrane is either pressed into the arbor from outside or is damaged, as a result of which the ink cartridge would become equally unusable. To make the membrane itself correspondingly stiff or resistant would specifically counteract the required easy pierceability during insertion onto the hollow needle of the printer, and is thus eliminated from consideration from the beginning. Through the invention, this conflict in goals is resolved, so that the membrane can continue to be made relatively thin and thus easily pierced so that the required functional properties are not negatively affected during operation.

With the procedure according to the invention, care must be taken that the covering of the membrane takes place before the ink space is provided with the transport vacuum. For process engineering reasons, it can be advantageous under some conditions for the covering to be applied even before the evacuation to full vacuum. Full function according to the invention is guaranteed that way as well.

Preferably, an inelastic film is applied to the membrane as the covering. It can be fastened in front of the opening in the wall of the dome, for example, or it can be joined to the supported edge regions of the membrane. It is preferable that this film be bonded or welded on.

When viewed from the outside, the membrane preferably exhibits a curved depression. Due to the fact that this depression is closed off by a flat covering, a taut, inelastic film, for example, a trapped air volume of defined size results.

The covering, the previously mentioned inelastic film, for example, is preferably applied in a detachable manner. That way, it can be easily removed by hand before insertion into the inkjet printer.

For carrying out the procedure according to the invention, it is advantageous for the evacuation and the filling of the ink space to be carried out through a single filler opening. Therefore, only the airtight sealing of a single opening is required, as a result of which the effort needed for manufacturing turns out to be correspondingly less.

A filling vacuum of at least 95%, preferably 97%, relative to the ambient atmosphere is chosen. A negative pressure of 50% or less is sufficient for the transport vacuum.

BRIEF DESCRIPTION OF THE-DRAWINGS

Figure 2:
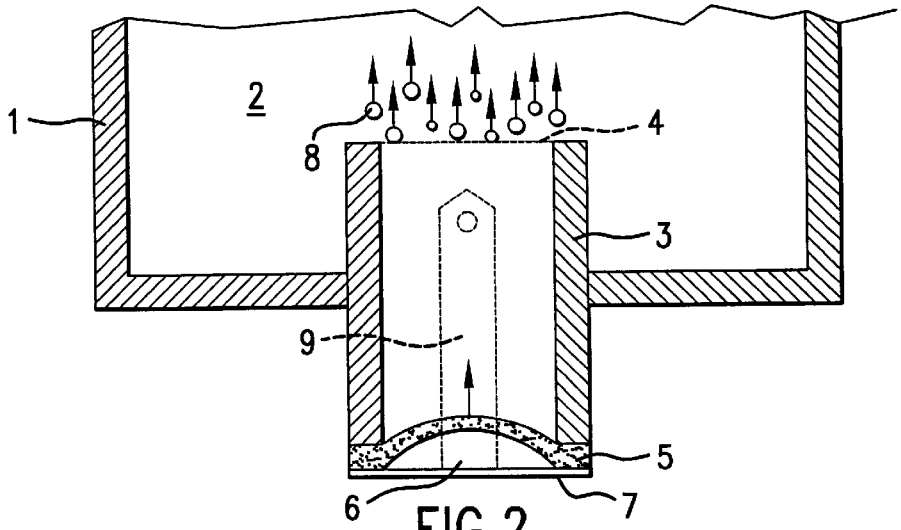
Figure 3:
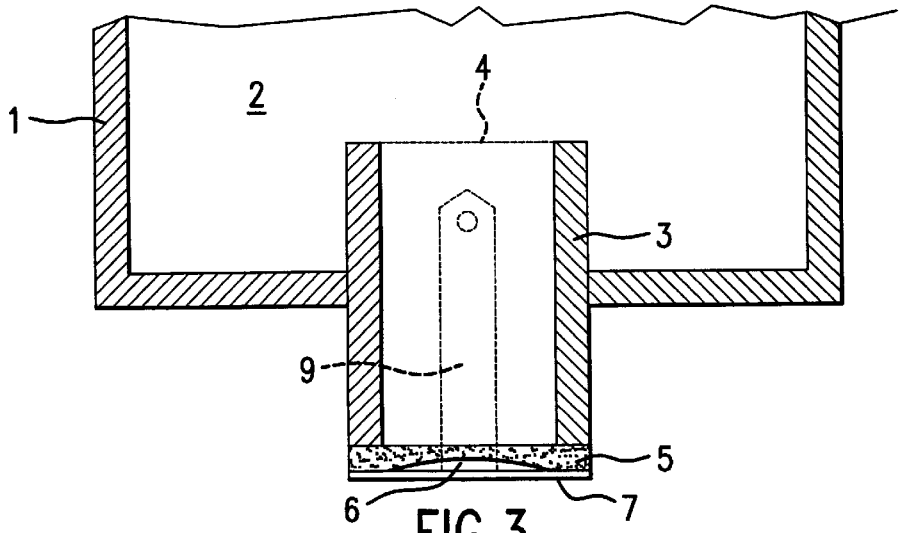

In the following, the execution of the procedure according to the invention is described with the aid of the drawings, which illustrate the individual steps of the procedure. Specifically, they show:

FIG. 1: A section view of the dome after being filled with ink and ventilated;

FIG. 2: A view as in FIG. 1, during evacuation to transport vacuum;

FIG. 3: A view as in FIG. 2 of the final state after filling.

Figure 4A:
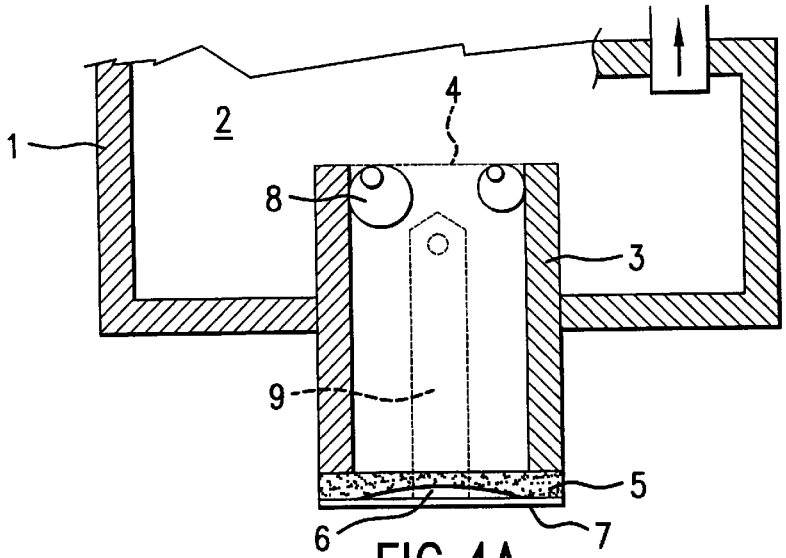
Figure 4B:
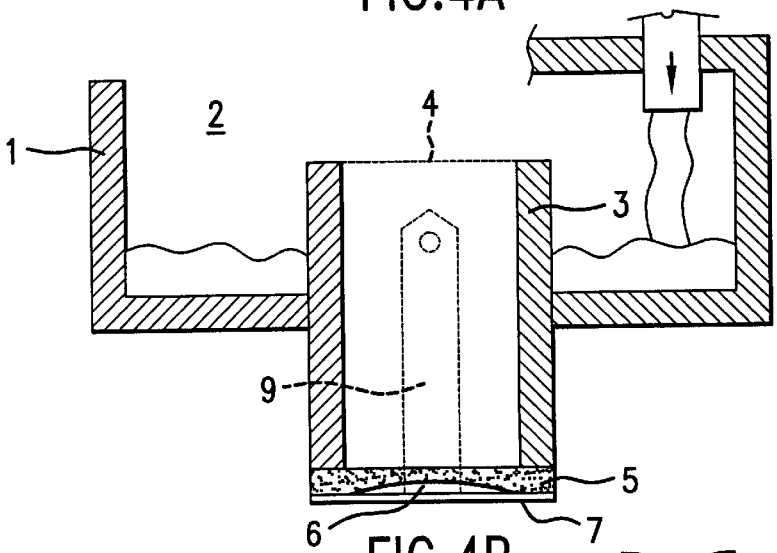
Figure 4C:
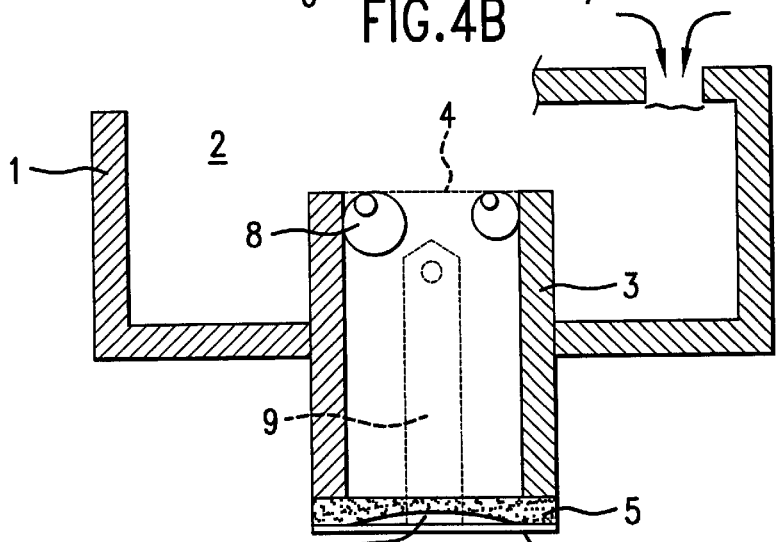

FIG. 4: containing FIGS. 4A, 4B, and 4C disclose schematically the steps of evacuating the ink space by a filling vacuum, filling ink into the ink space, and ventilating the ink space by connecting the filling/evacuation port to ambient air.

DETAILED DESCRIPTION OF THE INVENTION

FIGS. 1, 2 and 3 show views of phases during the execution of the procedure according to the invention, whereby the same reference numbers are used in each.

FIG. 4 uses the same reference numerals as FIGS. 1–3, and depicts schematically the steps of evacuating the ink space by filling a vacuum, filling ink into the ink space, and ventilating the ink space by connecting the filling/evacuation port to ambient air. These steps are previous to the steps of FIG. 1.

Shown in the drawings is a partial section view through the bottom region of an ink cartridge 1, the interior of which represents the ink space 2. The latter is completely filled with ink. Configured in the bottom of the cartridge 1 is the dome 3 in the form of a vertical tube section. Mounted on its upper end, which is directed into the ink space 2, is a fine-pore filter screen 4, for example, a fine-mesh stainless steel screen. Below, the dome 3 is sealed at the outer end by a pierceable membrane 5 made of an air-impermeable elastic material, a thermoplastic elastomer, for example. Tightly applied to the outside of this membrane 5, for example, welded or bonded, is a stiff covering 6, which is preferably formed from inelastic film. Trapped between the membrane 5, which has a concave depression on its underside, and the inelastic film 6 is a lenticular air volume 7, which is shown disproportionally large in order to make the invention clear.

FIG. 1 shows the state after the entire ink space 2 has been first filled with ink under a filling vacuum of about 97% , and then ventilated. The 3% residual air that remains has collected underneath the filter screen 4 in the interior of the dome 3 in the form of air bubbles 8. These air bubbles 8 are prevented by their surface tension from going through the filter screen 4 up into the ink space 2. As a result, there is a danger that in the operating state they would be drawn in by a hollow needle 9—shown here in dotted lines—and could lead to impairments during printing.

FIG. 2 shows a snapshot of the ink space 2 being provided with the transport vacuum. Because of the negative pressure, the air volume 7 expands, resulting in the membrane 5 being pressed into the interior of the dome 3. During this time, the rigid covering 6 remains essentially undeformed. As a result of the displacement of liquid taking place with the depressing of the membrane 5 inside the dome 3, the ink enclosed therein compresses. As this takes place, the air bubbles 8 are pressed through the filter screen 4 and into the ink space 2. There, they rise and collect at the top of the ink space 2, where they can be drawn off or remain.

Following the execution of the procedure according to the invention, the final state shown in FIG. 3 arises, in which—as shown—no residual air remains in the dome 3, or it is as least reduced to a remainder that does not harm the perfect operation of an attached inkjet printer.

To connect to the hollow needle 9 of an inkjet printer, the ink space 2 is again ventilated and the covering 6 subsequently removed. Due to the pressure equalization that takes place first as this is being done, there is no risk that the membrane 5 will expand inward excessively. Then the hollow needle 9 can be pressed in the usual way through the membrane 5 into the completely ink-filled—thanks to the procedure according to the invention—dome 3. Because of the small amount of residual air, perfect operation of a connected printing system is always provided.

What is claimed is:

1. A method for manufacturing an ink-filled ink cartridge for an inkjet printer, which, for a withdrawal of ink, has connected to an ink space a tubular dome, an outer end of which is closed off by a pierceable, airtight, elastic membrane, and an inner end of which is covered with a fine-mesh filter screen, said method comprising:

evacuating the ink space to a filling vacuum;

filling of ink into the ink space;

ventilating of the ink space;

evacuating the ink space to a transport vacuum;

sealing of the ink space; and wherein before said evacuating the ink space to the transport vacuum, a stiff covering is applied from the outside in front of said membrane in a sealing manner, thus trapping a defined air volume.

2. The method according to claim 1, wherein a covering is applied before said evacuation of the filling vacuum.

3. A method according to claim 1, wherein an inelastic film is applied to said membrane as the covering.

4. The method according to claim 1, wherein said membrane exhibits a concave depression.

5. The method according to claim 1, wherein said covering is detachable.

6. The method according to claim 1, wherein said evacuation, ventilation and filling of said ink space takes place through a single filling opening at a top of the dome.

7. The method according to claim 1, wherein said filling vacuum is at least 95% negative pressure relative to ambient atmospheric pressure.

8. The method according to claim 1, wherein said transport vacuum is approximately 50% negative pressure relative to ambient atmospheric pressure during filling.

* * * * *